United States Patent [19]

Becker

[11] 4,208,892

[45] Jun. 24, 1980

[54] SAMMIER PRESS

[75] Inventor: Arnold Becker, Murrhardt, Fed. Rep. of Germany

[73] Assignee: Louis Schweizer GmbH & Co. KG, Lederfabrik, Fed. Rep. of Germany

[21] Appl. No.: 972,213

[22] Filed: Dec. 22, 1978

[30] Foreign Application Priority Data

Dec. 22, 1977 [DE] Fed. Rep. of Germany ..... 2757257

[51] Int. Cl.[2] ..... C14B 1/30; C14B 1/06

[52] U.S. Cl. ..... 69/48; 69/43

[58] Field of Search ..... 69/48, 42, 43, 8

[56] References Cited

U.S. PATENT DOCUMENTS 3,040,554 6/1962 Griffin ..... 69/48

4,086,793 5/1978 Meyer ..... 69/48

FOREIGN PATENT DOCUMENTS 2351307 4/1975 Fed. Rep. of Germany ..... 69/48

*Primary Examiner*—Patrick D. Lawson

*Attorney, Agent, or Firm*—Craig & Antonelli

[57] ABSTRACT

The invention relates to a sammier press, especially for leather and fur, with a pressure roll and counter-pressure rolls bearing thereon, whereof at least one is driven, and with two conveyor belts moved by frictional engagement which receive the material that is to be pressed between them, drawing it through the pressing zone formed between the pressure roll and the counterpressure rolls.

23 Claims, 3 Drawing Figures

SAMMIER PRESS

Sammier presses are utilized especially in the leather and fur industry, for removal of water from the material. The problems particularly involved are throughput and residual moisture, as well as the treatment of the material in the sammy process.

A sammier press with two pressure plates is known (German AS 22 49 369) which functions intermittently. The material is brought between the two pressure plates by means of a conveyor device. A pressure cushion is then built up hydraulically at least on one pressure plate, said cushion having a membrane over it, and this cushion presses the material. The intermittent operation of this sammier allows only a small throughput, and the large pressing surface entails high pressures, involving construction of appropriate dimensions. In spite of the small throughput, such a sammier press is structurally large, and expensive in both manufacture and maintenance.

Sammier presses are also known in which the material is moved continuously through the machine. In one embodiment (German OS 17 60 381) two conveyor webs are taken parallel to each other, with a slight separation between them. A number of pressure pads or rolls acting successively are disposed on the outside of the conveyor webs. The leather is introduced between the webs and drawn by them through the pressing organs. Behind each pressing zone, there is a vacuum device which is supposed to suction off the expressed water. This machine is also complicated and expensive in construction, and because of the linear throughput of the material it takes up a lot of room. Also, the water removal is inadequate.

In the sammier press that has been mentioned, rigid pressure rolls and counterpressure rolls are utilized, whereby the counterpressure rolls are held on the pressure roll via compression springs or pneumatic pressure cushions under pressure. The conveyor belts are made as felt webs, and suck off the expressed liquid. This known throughput sammier press is very expensive to maintain, because the felt webs have to be replaced. They are deformed even after an operating time of about 6 to 8 months, because they can no longer take up the expressed liquid adequately. Moreover, with this sammier press, folds are so pressed into the material that they cannot be entirely eliminated in subsequent treatment.

It is the problem of the invention, so to improve the described sammier press, that with a protective throughput of the material there will be good water removal, and servicing or replacement of the conveyor belts can be avoided.

The problem of the invention is solved in that (a) a pressure roll is surrounded by an elastic hose, which together with the pressure roll forms a pressure cushion (b) three or more counterpressure rolls are distributed symmetrically on the periphery of the pressure roll, and (c) at least conveyor belt disposed at the outside comprises a water-permeable material in the region of the pressure roll.

The yielding property that is necessary for a protective treatment in the pressing zone is shifted to the pressure roll, while the conveyors must no longer be compressible and consequently have a longer life. On the other hand, the life expectancy of the pressure roll is not shortened either because of the hose need not take up any water and hence may be made of rubber for instance, which may be reinforced by fabric. By the arrangement of at least three counterpressure rolls, it is ensured that the hose will be symmetrically braced, and hence it cannot shift. The centering of the hose is promoted still further in that on the major part of its periphery it has the conveyor belts slung about it, and since they must not be made of elastic material, they cannot yield radially. In addition, after-pressing zones are formed between the individual counterpressure rolls, since the belts and hence the material that lies between them run over the pressure roll in a tensioned condition. The material needs only to be smoothed once at the intake, and it then retains its position. Practical experiments have demonstrated that a very good water removal is attainable.

It is true that textile wringers are known (U.S. Pat. No. 3,798,933) in which the textile material is moved between hose rolls that are under vacuum, and where additional supporting rolls are provided. However, since there is no centering by the conveyor belts, the hose rolls can be unilaterally deformed and bulge out in the spaces between the supporting rolls, with the result that there is no longer adequate pressure at the desired places. Such hose rolls in any case are used in very small sizes that do not come into question for the processing of leather. Also, there is no guarantee of fold-less intake of the material if it is taken through a plurality of pressing zones. Finally, substantial amounts of air are required to bring the whole cavity of the hose roll to the necessary pneumatic pressure.

According to a preferred embodiment of the invention, only the last counterpressure roll (in the conveying direction) is driven, thereby not only drawing the conveyor belts but also carrying along the pressure roll and the other counterpressure rolls via the pressure roll, by frictional engagement. In this way, torsion stresses in particular are kept away from the hose that encloses the pressure roll. It is further ensured that the conveyor belts will be tight in their passage through the press, so that on the one hand no water foci can collect between the belts, and on the other hand the centering of the hose of the pressure roll will be especially good.

The formation of the pressure cushion on the pressure roll according to one embodiment is such that the pressure roll is made as a length of tube, enclosed at a distance by a length of hose, in such a way that the tube length and the hose length are connected with each other at their ends in an airtight manner, and the chamber between the tube and the hose is filled with compressed air. In this way the chamber can be permanently pressurized, or it can be put under pressure when the machine is started up, and kept so.

Delivery of the compressed air is provided according to one embodiment in such a way that a compressed air line is brought into the tube length, welded airtight in a hole in the tube wall, opening into the chamber between the tube and the hose. Thus only the chamber and not the whole roll needs to be supplied with compressed air.

The invention will be discussed in detail below, with reference to an example of embodiment presented in the drawings.

Figure 1:
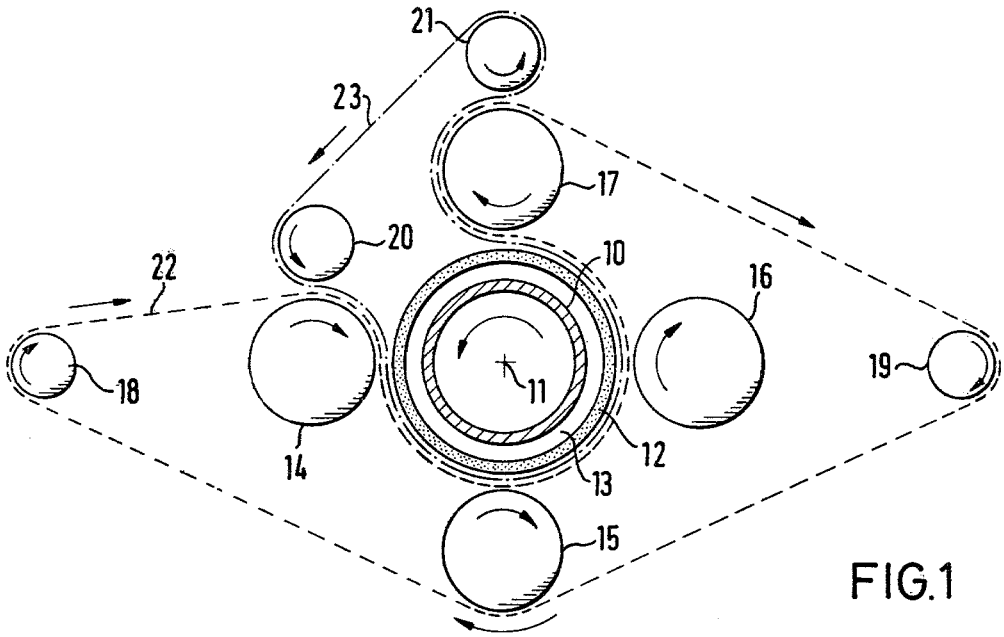
FIG. 1 is a schematic cross section of the sammier press

The core of the new sammier press is formed by the pressure roll equipped with a pressure cushion, said roll consisting of a tube length 10 and a hose length 12 which encloses it. Between the outer surface of tube 10 and the inner wall of hose 12, an airtight chamber 13 is formed. The inner diameter of hose 12 is therefore larger than the outer diameter of tube 10. Tube 10 and hose 12 are of equal length, and they are connected at both ends in an airtight manner.

Figure 2:
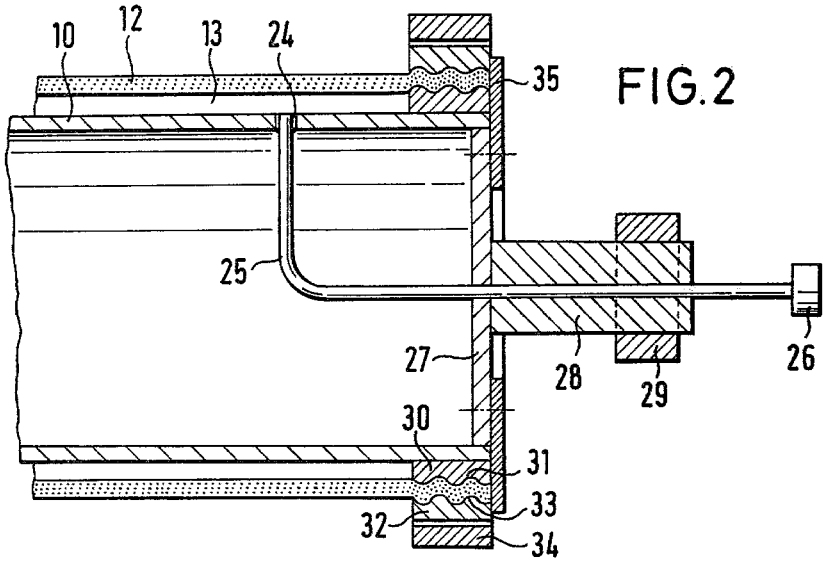
FIG. 2 is a partial section in the region of the end of the pressure roll.

A spacing ring 30 is placed on the outside of tube 10 in the end region, over which ring the hose 12 is put on, as the partial section of FIG. 2 shows. Clamping screws can be adjusted in a clamping ring 34 that encloses hose 12, said clamping screws pressing the individual clamping jaws 32 against hose 12, and again pressing it against spacing ring 30. The surfaces of spacing ring 30 and jaws 32 that are turned toward each other have reliefs 31 and 33 which are mutually related and preferably helicoidal, ensuring a clean clamping of hose 12.

Figure 3:
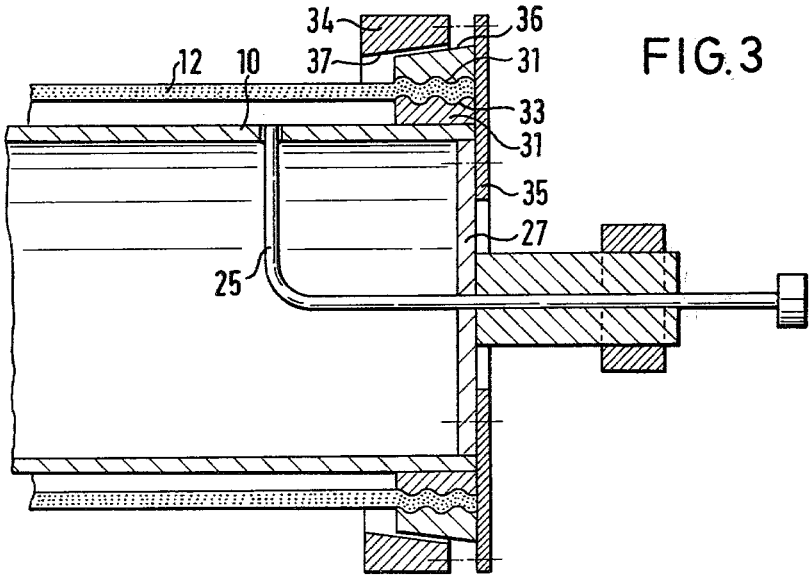
FIG. 3 is a partial section, similar to that of FIG. 2, of another form of embodiment.

In the embodiment according to FIG. 3, the clamping jaws 32, which may be part-ring segments for example, have a wedging surface 36. A corresponding surface 37 of a clamping ring 34 acts against said surface. Ring 34 is drawn together by coaxial bolts.

The ends of tube 10 are closed by plates 27. On one end, compressed air line 25 is led through bearing shaft 28 of the pressure roll, which is rotatably borne in bearing 29. Compressed air line 25 is guided in a bore 24 in the wall of tube 10 and welded there in an airtight manner, so that compressed air line 25 opens into chamber 13 between tube 10 and hose 12. Compressed air line 25 is therefore connected so as to be fixed in rotation with tube 10 and bearing shaft 28. The end of compressed air line 25 that extends beyond shoulder 28 has a rotary coupling 26 so that a stationary compressed air connection can be established.

Chamber 13 is permanently filled with compressed air, or only during operating time, at about 10 to 25 atm, so that hose 12 will be correspondingly expanded. Said hose 12 is advantageously provided with a fabric inlay, and has a wall thickness of 10 to 20 mm, to withstand this pressure.

As FIG. 1 shows, there are four counterpressure rolls 14, 15, 16 and 17 disposed about the pressure roll, where counterpressure rolls 14 and 16 are more or less in a horizontal plane and rolls 15 and 17 more or less in a vertical plane. These four counterpressure rolls 14, 15, 16 and 17, with the pressure roll, form four narrow pressure zones on which hose 12 can hardly spread out.

Two conveyor belts 22 and 23 are provided, to guide the material: of these conveyor belts, at least the lower belt 22 is perforated, and made for example of plastic or steel. Lower belt 22 forms a delivery device for the material from which the water is to be expressed, with its loop from deflector roll 18 that is upstream of counterpressure roll 14. Lower belt 22 encloses hose 12 but is turned toward counterpressure rolls 14, 15, 16 and 17, and runs through all the pressing zones. In the same way, upper belt 23 is guided about the pressure roll, but is turned toward hose 12. The deflector roll 20 for upper conveyor belt 23 is disposed above the intake counterpressure roll 14, so that material delivered on the lower belt will be drawn between the two belts 22 and 23 that are guided around deflector roll 20 and intake counterpressure roll 14, and conveyed in succession to pressure zones of counterpressure rolls 14, 15, 16 and 17. Belts 22 and 23 have only a guiding function, and the expressed liquid can flow off through the perforations in these webs. The water removal process is determined by the pressure of the compressed air in chamber 13. Since counterpressure rolls 14, 15, 16 and 17 have a rubber coating, and hose 12 is still yielding enough in the pressure zones, the material as it passes through this new sammier press will be protectively treated and will leave the press with only a very small quantity of residual moisture. Since hose 12 is bulged out between the pressure zones, and pressed against belts 22 and 23, there is a subsequent pressing process between counterpressure rolls 14 and 15, 15 and 16, as well as 16 and 17. The driven pressure roll takes along belts 22 and 23 by frictional engagement, in the directions indicated by the arrows, and also counterpressure rolls 14, 15, 16 and 17 as well as deflector rolls 18, 19, 20 and 21 are of necessity turned in the indicated directions by frictional engagement.

After passage through the pressure zone between the upper outlet counterpressure roll 17, the loop of the lower conveyor belt 22 over deflector roll 19 and lower counterpressure roll 15 to the intake deflector roll 18 is closed. The portion of the lower belt 22 between outlet counterpressure roll 17 and the deflector roll 19 serves as a takeoff device for the dried material. Upper belt 23 is taken around deflector roll 21, and the loop is directly closed to the intake deflector roll 20.

In the illustrated embodiment, the upper counterpressure roll 17 is driven and carries along the conveyor belts and also the pressure roll and therewith the rest of the counterpressure rolls 14, 15 and 16.

In order that the expressed liquid may flow off better, counterpressure rolls 14, 15, 16 and 17 may be provided on their outer surfaces with a relief that will principally carry the water off to the side. The expressed liquid can then be readily collected in a trough.

To achieve still better water removal, or to produce still more pressure zones, two pressure rolls can be disposed one behind the other in the direction of travel. In this case, two adjacent counterpressure rolls can cooperate with both pressure rolls, so that only six counterpressure rolls will be required, but eight pressure zones will be formed.

I claim:

1. Sammier press, especially for leather and fur, with a pressure roll and counterpressure rolls bearing thereon, whereof at least one of said rolls is driven, and with two conveyor belts that are moved by frictional engagement, said belts being operable to receive the material that is to be expressed between them and draw it through pressure zones formed between the pressure roll and the counterpressure rolls, characterized in that:

(a) the pressure roll is comprised by a tube surrounded by an elastic hose which together form a pressure cushion, (b) three or more counterpressure rolls are symmetrically distributed about the periphery of the pressure roll, and (c) wherein one of said conveyor belts is disposed about said pressure roll and the other of said conveyor belts is disposed, in part, in facing relationship to said one conveyor belt, at least the other conveyor belt comprising a water-permeable material in the region of the pressure roll.

2. Sammier press as in claim 1, characterized in that only a last of said counterpressure rolls, in the direction of travel, is driven.

3. Sammier press as in claims 1 or 2, characterized in that four counterpressure rolls are provided, whereof two are disposed on opposite sides of said pressure roll in a horizontal plane and two are disposed on opposite sides of the pressure roll in a vertical plane.

4. Sammier press as in claim 3, characterized in that an intake for material from which water is to be removed has a counterpressure roll disposed in the horizontal plane, and an outlet is provided on an upper counterpressure roll, said upper counterpressure roll being the last of said pressing rolls in the direction of material travel.

5. Sammier press according to claim 4, characterized in that the tube is enclosed at a distance by the hose, and in that the tube and the hose are interconnected at their ends in an air-tight manner, and in that a chamber formed between the tube and the hose is filled with compressed air.

6. Sammier press as in claim 5, characterized in that a compressed air line is introduced into the tube, said line being welded in an airtight manner in a bore in a wall of the pipe and opening into the chamber between the tube and the hose.

7. Sammier press as in claim 5, characterized in that the compressed air line is connected with the pipe and a bearing shaft for said pipe so as to be fixed in rotation, and in that an end of the compressed air line that is outside the bearing shaft is provided with a rotary coupling for a stationary hose connection or the like.

8. Sammier press as in claim 1, characterized in that the tube is provided with a spacing ring at its periphery, in the region of its ends, in that clamping part-ring segments enclose the hose and are pressed against the hose by means of a clamping device that engages them, and in that the said hose is tensioned against the spacing ring.

9. Sammier press as in claim 8, characterized in that the spacing ring and the clamping segments have reliefs on their surfaces which face each other directed in the peripheral direction of said surfaces.

10. Sammier press as in claim 8, characterized in that the ends of the tube are closed by plates and in that supporting ring plates are placed on the said plates, the said ring plates covering the ends of the hose which are clamped between the spacing ring and the clamping jaws.

11. Sammier press according to claim 4, characterized in that one conveyor belt after passing the upper counterpressure roll is taken over a deflector roll disposed in a horizontal plane, then over a lower counterpressure roll disposed in a vertical plane and finally over another deflector roll upstream of the intake, while the other conveyor belt after leaving the upper counterpressure roll is taken back over a deflector roll positioned above the upper counterpressure roll to a deflector roll upstream of the intake.

12. Sammier press as in claim 1, characterized in that the counterpressure rolls are provided with a rubber coating.

13. Sammier press as in claim 11, characterized in that the outer surfaces of the counterpressure rolls have reliefs that lead the water off to the side.

14. Sammier press as in claim 1, or 8, or 12, characterized in that the hose is provided with a fabric inlay and has a wall thickness of 10 to 20 mm.

15. Sammier press as in claim 1, characterized in that a second pressure roll with counterpressure rolls is associated with the pressure roll and the counterpressure rolls, whereby two adjacent counterpressure rolls are applied to both pressure rolls with different zones of their respective peripheries.

16. Sammier press as in claim 1, characterized in that an intake for material from which water is to be removed has a counterpressure roll disposed in the horizontal plane, and an outlet is provided on an upper counterpressure roll, said upper counterpressure roll being the last of said pressing rolls in the direction of material travel.

17. Sammier press according to claim 1, characterized in that the tube is enclosed at a distance by the hose, and in that the tube and the hose are interconnected at their ends in an air-tight manner, and in that a chamber formed between the tube and the hose is filled with compressed air.

18. Sammier press as in claim 17, characterized in that a compressed air line is introduced into the tube, said line being welded in an airtight manner in a bore in a wall of the pipe and opening into the chamber between the tube and the hose.

19. Sammier press as in claim 17, characterized in that the compressed air line is connected with the pipe and a bearing shaft for said pipe so as to be fixed in rotation, and in that an end of the compressed air line that is outside the bearing shaft is provided with a rotary coupling for a stationary hose connection or the like.

20. Sammier press as in claim 19, characterized in that the tube is provided with a spacing ring at is periphery, in the region of its ends, in that clamping part-ring segments enclose the hose and are pressed against the hose by means of a clamping device that engages them, and in that the said hose is tensioned against the spacing ring.

21. Sammier press as in claim 20, characterized in that the spacing ring and the clamping segments have relief on their surfaces which face each other directed in the peripheral direction of said surfaces.

22. Sammier press as in claim 20, characterized in that the ends of the tube are closed by plates and in that supporting ring plates are placed on the said plates, the said ring plates covering the ends of the hose which are clamped between the spacing ring and the clamping jaws.

23. Sammier press according to claim 16, characterized in that one conveyor belt after passing the upper counterpressure roll is taken over a deflector roll disposed in a horizontal plane, then over a lower counterpressure roll disposed in a vertical plane and finally over another deflector roll upstream of the intake, while the other conveyor belt after leaving the upper counterpressure roll is taken back over a deflector roll positioned above the upper counterpressure roll to a deflector roll upstream of the intake.

* * * * *